United States Patent [19]

Zaprazny

[11] 4,262,949

[45] Apr. 21, 1981

[54] LIFT ADAPTOR FOR AN ELECTROMAGNET FOR HYDRAULIC OR EXCAVATOR CRANE

[76] Inventor: Joseph W. Zaprazny, R.D.#1, P.O. Box 18, New Ringgold, Pa. 17960

[21] Appl. No.: 90,508

[22] Filed: Nov. 2, 1979

[51] Int. Cl.[3] ..... B66C 3/16; E02F 3/44

[52] U.S. Cl. ..... 294/65.5

[58] Field of Search ..... 294/65.5, 88; 414/737, 414/626

[56] References Cited

U.S. PATENT DOCUMENTS

| | | | |
|---|---|---|---|
| 3,040,921 | 6/1962 | Davis | 294/65.5 |
| 4,005,895 | 2/1977 | Cullings | 294/65.5 |

*Primary Examiner*—James B. Marbert

*Attorney, Agent, or Firm*—Keil & Witherspoon

[57] ABSTRACT

A lift crane adaptor for fastening an electromagnet to a lift crane boom including a metal plate to one face of which three magnet mounting brackets are attached, each containing fastening means for fastening to an electromagnet, and to the opposite face of which is attached a crane mounting bracket with means for fastening to a lift crane boom.

7 Claims, 6 Drawing Figures

LIFT ADAPTOR FOR AN ELECTROMAGNET FOR HYDRAULIC OR EXCAVATOR CRANE

BACKGROUND OF THE INVENTION

The present invention relates to a lift adaptor for connecting an electromagnet to a lift crane boom. Electromagnets for lifting material have been known for many years. A lift chain assembly is commonly used to attach an electromagnet to the hook of an overhead crane. Generally, the lift chain assembly employs a master link having an eye through which a crane hook passes and having means for connecting thereto three suspension chains. The tops of the suspension chains are connected to the master link and the bottoms thereof are connected to the electromagnet so that the electromagnet can be raised and lowered by the crane. However, the suspension chains used permit the electromagnet to swing freely, thereby reducing the effective control of the crane operator. Furthermore, suspension chains do not permit the crane operator to exert a compressive force through the electromagnet on material to be lifted. In addition, the suspension chains do not permit the crane operator to control the electromagnet by inclining or tilting the magnet.

SUMMARY OF THE INVENTION

Briefly, in accordance with the invention a lift adaptor for an electromagnet is described and illustrated which overcomes the problems mentioned above and gives the crane operator complete control of the magnet in various positions, permitting the crane operator to incline or tilt the magnet. The lift adaptor for an electromagnet of the present invention further permits the crane operator to operate the magnet more efficiently by preventing the magnet from swinging freely at the end of the lift crane boom. The lift adaptor for an electromagnet of the present invention also permits the crane operator to apply a compressive force to the electromagnet to compress the material to be picked up by the magnet. The ability of the crane operator to apply a compressive force to the electromagnet to compress the material to be picked up by the magnet is particularly important when the material to be picked up by the magnet is bulky and of low density. Compressing the material to be picked up permits the crane operator to operate the electromagnet more efficiently by picking up more material, and to load a truck or container more efficiently with higher density material. Furthermore, the ability of the crane operator to incline or tilt the electromagnet in accordance with the present invention permits the magnet to reach material from hard-to-reach corners or angles, thereby making the electromagnet much more effective.

Other advantages of the present invention will be apparent from the drawings, and the detailed description of the invention which follow.

BRIEF DESCRIPTION OF THE DRAWINGS

The structure and operation of the lift adaptor for connecting an electromagnet to a crane lift hook in accordance with the present invention will now be more fully described in the following detailed description taken with the accompanying drawings wherein.

DETAILED DESCRIPTION

Figure 1:
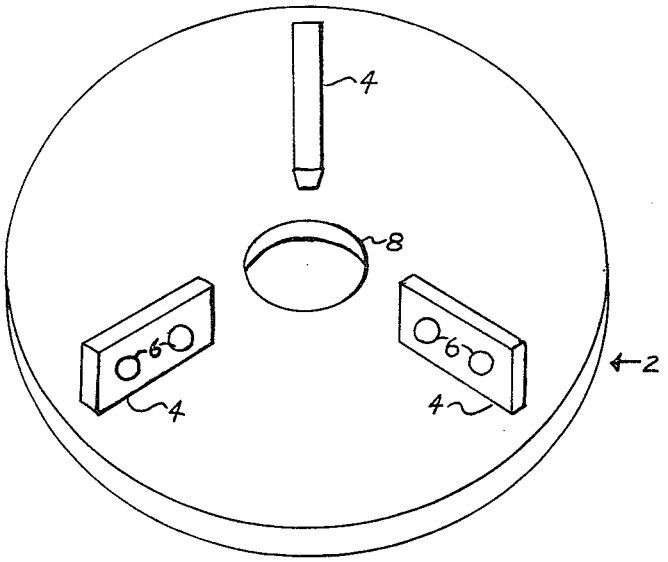
FIG. 1 is a bottom perspective view of a lift adaptor for connecting an electromagnet to a crane lift boom in accordance with the present invention.
Figure 2:
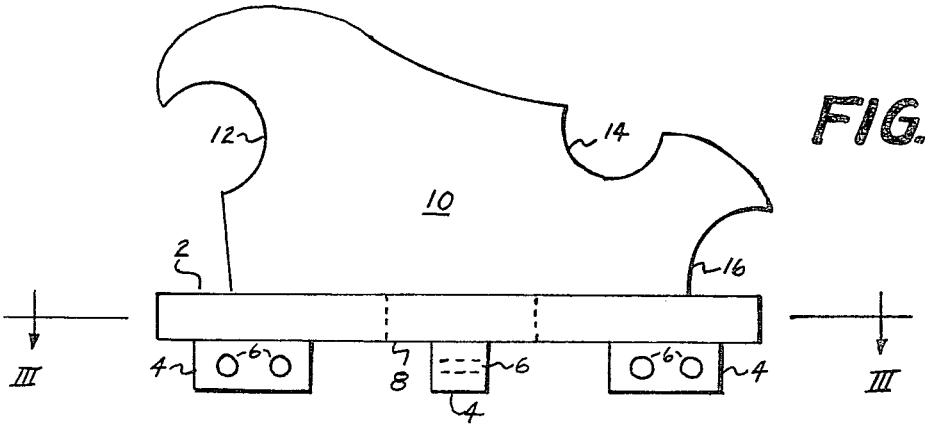
FIG. 2 is a front view of a lift adaptor for connecting an electromagnet to a crane lift boom in accordance with the present invention.
Figure 3:
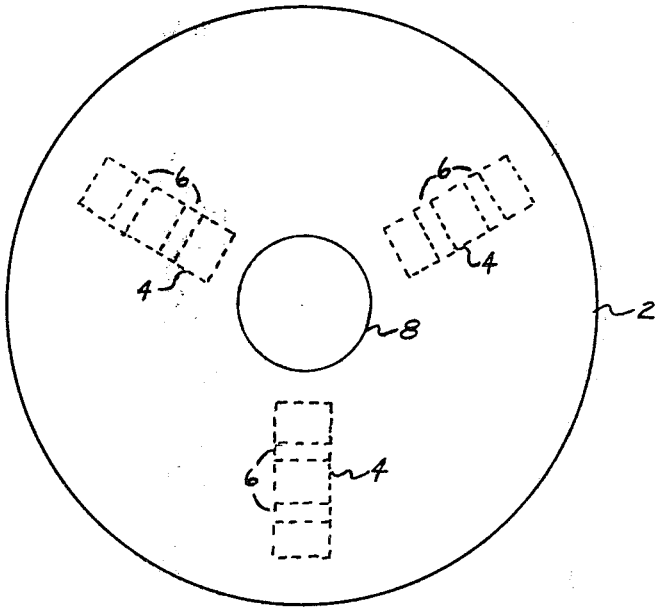
FIG. 3 is a top view taken along the line III—III of FIG. 2, of a lift adaptor for connecting an electromagnet to a crane lift boom in accordance with the present invention.

Referring now to FIGS. 1, 2 and 3, it will be seen that the lift adaptor for connecting the electromagnet to a crane lift boom in accordance with the present invention comprises a metal plate designated generally by reference number 2 having a bottom, magnet engaging, face illustrated in FIG. 1 and a top, lift crane engaging, face illustrated (without a crane mounting bracket) in FIG. 3. Three downwardly projecting magnet mounting brackets 4 are provided on the bottom, magnet engaging, face of metal plate 2. Each magnet mounting bracket 4 is provided with at least one mounting hole 6. Preferably each magnet mounting bracket 4 is provided with two mounting holes 6 as illustrated in FIG. 1. Metal plate 2 is also provided with a centrally disposed hole 8 through which the electrical power connections for an electromagnet can be passed from a lift crane boom to an electromagnet mounted on a lift adaptor according to the present invention.

Figure 6:
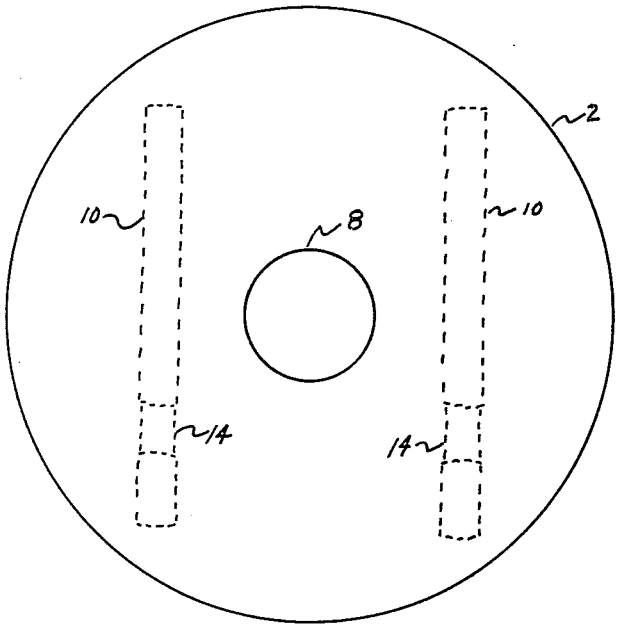
FIG. 6 is a bottom view taken along the line III—III of FIG. 2, of a lift adaptor with two crane mounting brackets for connecting an electromagnet to a crane lift boom in accordance with the present invention.
Figure 5:
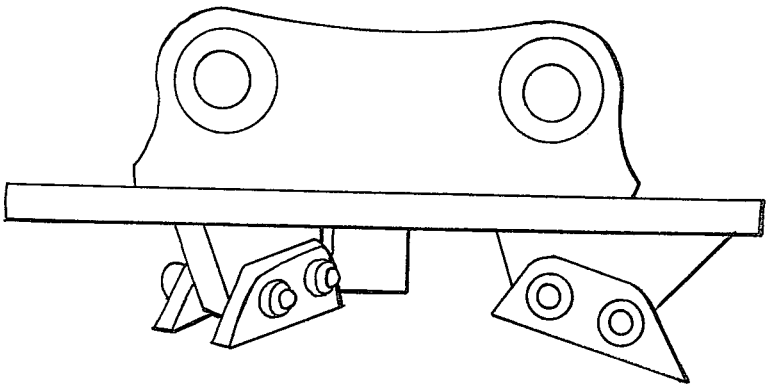
FIG. 5 is a view of lift adaptor mounted to the electromagnet to a Hydraulic Excavator or Crane.

The top, lift crane boom engaging, face of metal plate 2 is provided with at least one crane mounting bracket, generally indicated by reference number 10. Preferably the top, lift crane boom engaging, face of metal plate 2 is provided with two crane mounting brackets 10, as illustrated in FIG. 6. Each crane mounting bracket 10 is provided with two or three lift crane boom engaging indents 12, 14 and 16. Mounting Brackets ref. #10 must be modified to fit various boom styles. Lift crane engaging indents 12, 14 and 16 are designed to engage a crane lift block (not shown). Generally, a crane lift block includes means such as bars which engage indents 12, 14 and 16 and which may be independently manipulated by the crane operator. The crane operator may thus apply an upward force to indent 12 relative to indent 16, causing the lift crane adaptor to incline or tilt upward. Similarly, the crane operator may apply an upward force to indent 16 relative to indent 12, thereby causing the lift crane adaptor to incline or tilt downward. In this manner, the crane operator may attain complete control over the lift crane adaptor of the present invention.

Figure 4:
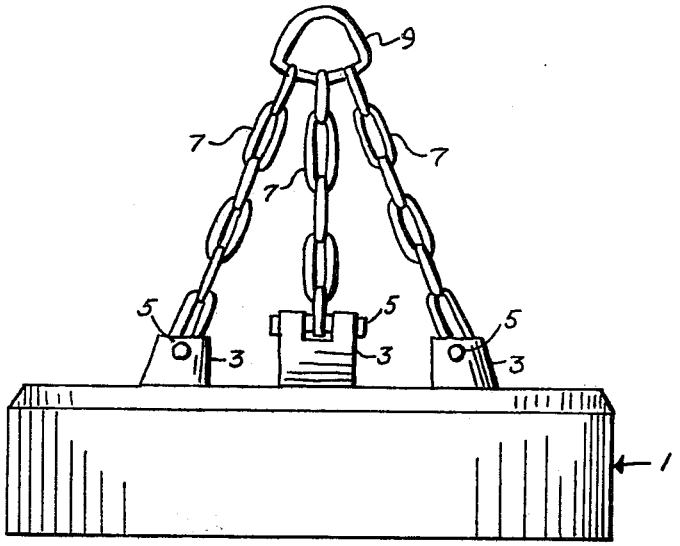
FIG. 4 is a front view of a suspension chain assembly used in the prior art to attach an electromagnet to a crane lift hook.

An electromagnet is attached to the lift crane adaptor of the present invention by engaging magnet mounting brackets 4 containing mounting holes 6 with three upwardly projecting anchors 3, as illustrated in FIG. 4. The electrical power connection (not shown) to a lift electromagnet is conveniently passed through hole 8 to the lift crane boom.

A prior art suspension chain assembly is illustrated in FIG. 4. An electromagnet, generally designated by reference number 1 is provided with three upwardly projecting anchors 3. Suspension chains 7 are attached to anchors 3 by anchor pins 5. A master link or bull ring 9 connects the three suspension chains 7 to a crane hook (not shown). The disadvantages of a suspension chain adaptor are fully described above.

The thickness of metal plate 2, magnet mounting brackets 4, and crane mounting bracket 10 will be determined by the size of the electromagnet to be mounted. Magnet mounting brackets 4 and crane mounting bracket 10 are fastened immovably to metal plate 2, preferably by being welded thereto. It is believed that the operation of the apparatus of the present invention is clearly apparent from the foregoing description.

It is understood that various other modifications will be apparent to and can readily be made by those skilled in the art without departing from the scope and spirit of this invention. Accordingly, it is not intended that the scope of the claims appended hereto to be limited to the description set forth above, but rather that the claims be construed as encompassing all of the patentable features which reside in the present invention, including all features which would be treated as equivalents thereof by those skilled in the art to which the invention pertains.

What is claimed is:

1. A lift crane adaptor for an electromagnet, comprising:

a metal plate having a magnet engaging face and an opposite lift crane engaging face, at least three magnet mounting brackets fastened immovably to the magnet engaging face of said metal plate, said magnet mounting brackets containing fastening means for fastening said brackets to an electromagnet, and at least one crane mounting bracket fastened immovably to the lift crane engaging face of said metal plate containing fastening means for fastening said crane mounting bracket to a lift crane boom.

2. A lift crane adaptor for an electromagnet according to claim 1 including two crane mounting brackets fastened immovably to the lift crane engaging face of said metal plate.

3. A lift crane adaptor for an electromagnet according to claim 1 including three magnet mounting brackets fastened immovably to the magnet engaging face of said metal plate.

4. A lift crane adaptor for an electromagnet according to claim 1 including a centrally disposed hole adapted for passing an electrical power cord from an electromagnet to a lift crane boom.

5. A lift crane adaptor for an electromagnet according to claim 1 or claim 2 wherein said crane mounting brackets comprise at least two indents adapted to engage a lift crane boom.

6. A lift crane adaptor for an electromagnet according to claim 5 wherein said crane mounting brackets comprise three indents adapted to engage a lift crane boom.

7. A lift crane adaptor for an electromagnet according to claim 1, consisting of:

a metal plate having a magnet engaging face and an opposite lift crane engaging face, and including a centrally disposed hole adapted for passing an electrical power connection from an electromagnet to a lift crane boom, three magnet mounting brackets fastened immovably to the magnet engaging face of said metal plate, said magnet mounting brackets containing fastening means for fastening said brackets to an electromagnet, and two crane mounting brackets fastened immovably to the lift crane engaging face of said metal plate, each containing three indents adapted to engage a lift crane boom.

* * * * *